US012710246B2

(12) United States Patent
Johnson et al.

(10) Patent No.: US 12,710,246 B2
(45) **Date of Patent: *Aug. 18, 2026**

(54) TOY LAUNCH APPARATUS WITH MOMENTUM FEATURE AND CONCENTRIC PISTON

(71) Applicant: Crosman Corporation, Bloomfield, NY (US)

(72) Inventors: Arvid Johnson, Bloomfield, NY (US); Christopher David Miller, Clifton Springs, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/223,752

(22) Filed: May 30, 2025

(65) Prior Publication Data

US 2025/0354778 A1 Nov. 20, 2025

Related U.S. Application Data

(63) Continuation of application No. 18/375,437, filed on Sep. 29, 2023, now Pat. No. 12,320,612.
(Continued)

(51) Int. Cl.
*F41B 11/00* (2013.01)
*F41B 11/643* (2013.01)
(Continued)

(52) U.S. Cl.
CPC ..... *F41B 11/643* (2013.01); *F41B 11/646* (2013.01); *F41B 11/89* (2013.01)

(58) Field of Classification Search
CPC ..... F41B 11/642; F41B 11/643; F41B 11/646; F41B 11/89; F41B 11/62; F41B 11/723; F41B 11/50; F41B 11/54; F41B 11/647
(Continued)

(56) References Cited

U.S. PATENT DOCUMENTS 1,043,534 A 11/1912 Norman
2,505,428 A 4/1950 Pope
(Continued)

OTHER PUBLICATIONS

"New Diamond dog bolt action blaster, accept long and short darts" retrieved on Sep. 7, 2022 at https://www.reddit.com/r/Nerf/comments/x84wyp/new_diamond_dog_bolt_action_blaster_accept_long/.
(Continued)

*Primary Examiner* — Michael D David
(74) *Attorney, Agent, or Firm* — Lee & Hayes, P.C.

(57) ABSTRACT

An air launch apparatus includes a frame, a grip, and a plurality of sidewalls and also includes a hollow substantially cylindrical barrel having a central longitudinal axis. The air launch apparatus further includes a piston disposed substantially concentric with the barrel. The piston is configured to move longitudinally along the outer surface of the barrel in directions parallel to the longitudinal axis. The air launch apparatus also includes a nut that is configured to engage the piston as a front block carrying the nut is drawn rearward toward a user, and to hold the piston stationary relative to the front block while so engaged. A plunger, fixedly connected to the piston, is configured to move with the piston. Movement of the piston and plunger, forward during cocking draws air into a volume within an air chamber of the air launch apparatus.

11 Claims, 13 Drawing Sheets

Related U.S. Application Data

(60) Provisional application No. 63/412,103, filed on Sep. 30, 2022.

(51) Int. Cl.
*F41B 11/646* (2013.01)
*F41B 11/89* (2013.01)

(58) Field of Classification Search
USPC ..... 124/63–69, 37, 40, 45, 51.1, 31, 48
See application file for complete search history.

(56) References Cited

U.S. PATENT DOCUMENTS

| | | | | |
|---|---|---|---|---|
| 2,567,643 | A | 9/1951 | Lumir | |
| 2,633,838 | A | 4/1953 | Lee | |
| 3,163,951 | A * | 1/1965 | Lewis | F41A 21/488 42/62 |
| 3,212,490 | A | 10/1965 | Rudolf | |
| 3,547,095 | A | 12/1970 | Vadas et al. | |
| 3,612,026 | A | 10/1971 | Vadas et al. | |
| 3,788,298 | A | 1/1974 | Hale | |
| 3,913,553 | A | 10/1975 | Braughler et al. | |
| 4,019,423 | A * | 4/1977 | Johnson | F41A 21/12 89/197 |
| 4,756,297 | A | 7/1988 | Sindel | |
| 4,834,059 | A | 5/1989 | Moorhouse | |
| 5,622,159 | A | 4/1997 | Liu et al. | |
| 5,824,943 | A | 10/1998 | Guhring et al. | |
| 6,343,598 | B1 | 2/2002 | Pshenychny | |
| 8,596,255 | B2 | 12/2013 | Meggs | |
| 8,720,426 | B2 | 5/2014 | Hadley et al. | |
| 10,823,524 | B2 * | 11/2020 | Myers | G09B 9/00 |
| 11,243,044 | B2 | 2/2022 | Chia | |
| 11,519,689 | B2 | 12/2022 | Chia | |
| 11,898,589 | B2 * | 2/2024 | Gomez | F16B 37/00 |
| 2012/0085225 | A1 * | 4/2012 | Vanek | F41A 5/06 89/163 |
| 2024/0110763 | A1 | 4/2024 | Johnson | |

OTHER PUBLICATIONS

Office Action for U.S. Appl. No. 18/375,437, mailed on Oct. 1, 2024, 5 pages.

PCT Search Report and Written Opinion mailed Feb. 7, 2024 for PCT Application No. PCT/US2023/034237 from PCT Summary, 12 pages.

* cited by examiner

TOY LAUNCH APPARATUS WITH MOMENTUM FEATURE AND CONCENTRIC PISTON

CROSS-REFERENCE TO RELATED APPLICATION

This application is a continuation of and claims priority to U.S. application Ser. No. 18/375,437, filed, Sep. 29, 2023, which claims priority to U.S. Provisional Patent Application No. 63/412,103, filed Sep. 30, 2022, the entire contents of which are incorporated herein by reference

FIELD OF THE INVENTION

The present disclosure relates to a toy launch apparatus, and in particular, air launch apparatus having a substantially cylindrical barrel and a substantially cylindrical piston disposed concentric with the barrel. In some examples, the barrel is held stationary relative to the piston via a nut that is disposed about an outer surface of the barrel.

BACKGROUND OF THE INVENTION

Existing air launch apparatuses typically utilize a central barrel to eject foam darts or other projectiles down range toward a target. Such air launch apparatuses are configured to supply a burst of pressurized gas upstream of the projectile, thereby urging the projectile to pass through a central channel of the barrel and to exit the barrel at a front end of the air launch apparatus. Such air launch apparatuses, however, typically suffer from inefficient pressurization of the gas upstream of the projectile. Additionally, such air launch apparatuses often require relatively large footprint to accommodate a chamber or other compartment large enough to accommodate sufficient pressurized gas to eject the projectile at desired velocities.

Existing air launch devices tend to be unwieldy, such as from having pressure chambers pistons, etc. formed in line with one another or side by side. In order to have the desired performance, such devices are wider than would be desired or much longer than desired.

The example embodiments of the present disclosure are directed toward overcoming the deficiencies described above.

SUMMARY

Example embodiments of the present disclosure include an air launch apparatus having a frame, and a grip. The air launch apparatus also includes a hollow substantially cylindrical barrel having a central longitudinal axis. In such examples, the air launch apparatus further includes a piston disposed substantially concentric with the barrel. For instance, an example piston may be disposed substantially around an outer surface of the barrel and may be configured to move longitudinally along the outer surface of the barrel in directions parallel to the longitudinal axis. The air launch apparatus may further include a nut that is configured to engage the piston as a front block carrying the nut is drawn rearward toward a user (e.g., during cocking of the air launch apparatus), and to hold the piston stationary relative to the front block while so engaged. During cocking of the air launch apparatus, the front block and the piston may then be moved, in unison, forward (away from the user)

The example air launch apparatus may further include a plunger fixedly connected to the piston and configured to move with the piston. In such examples, movement of the piston, together with the plunger, forward (away from the user and/or away from a grip of the air launch apparatus) during cocking may open and/or increase a volume within an air chamber of the air launch apparatus with which the piston is engaged. In some examples, the piston may form a substantially fluid-tight seal with an internal surface of the air chamber. In such examples, the plunger, together with the piston, may be driven rearward (toward the user) during firing of the air launch apparatus. A compressed spring or other resistance member of the air launch apparatus may act on the plunger to drive the piston and the plunger rearward. As the plunger is driven rearward, the plunger may compress gas disposed within the air chamber, and may force such pressurized gas to move rearward toward the user. The gas may impinge upon and/or may otherwise be directed by a cap disposed at the rear of the air chamber, and as such, the gas may then be forced to reverse directions (i.e., to move forward, away from the user) by passing through a passage leading to a rear surface of a projectile (e.g., a foam dart or other such round of ammunition) disposed within the barrel. In some examples, such a passage may be formed by the cap. Such pressurized gas may impinge upon the projectile and may urge the projectile to pass through a central passage of the barrel, along the longitudinal axis, and to exit the air launch apparatus via an exit port disposed at a front and of the air launch apparatus.

DETAILED DESCRIPTION

Figure 1:
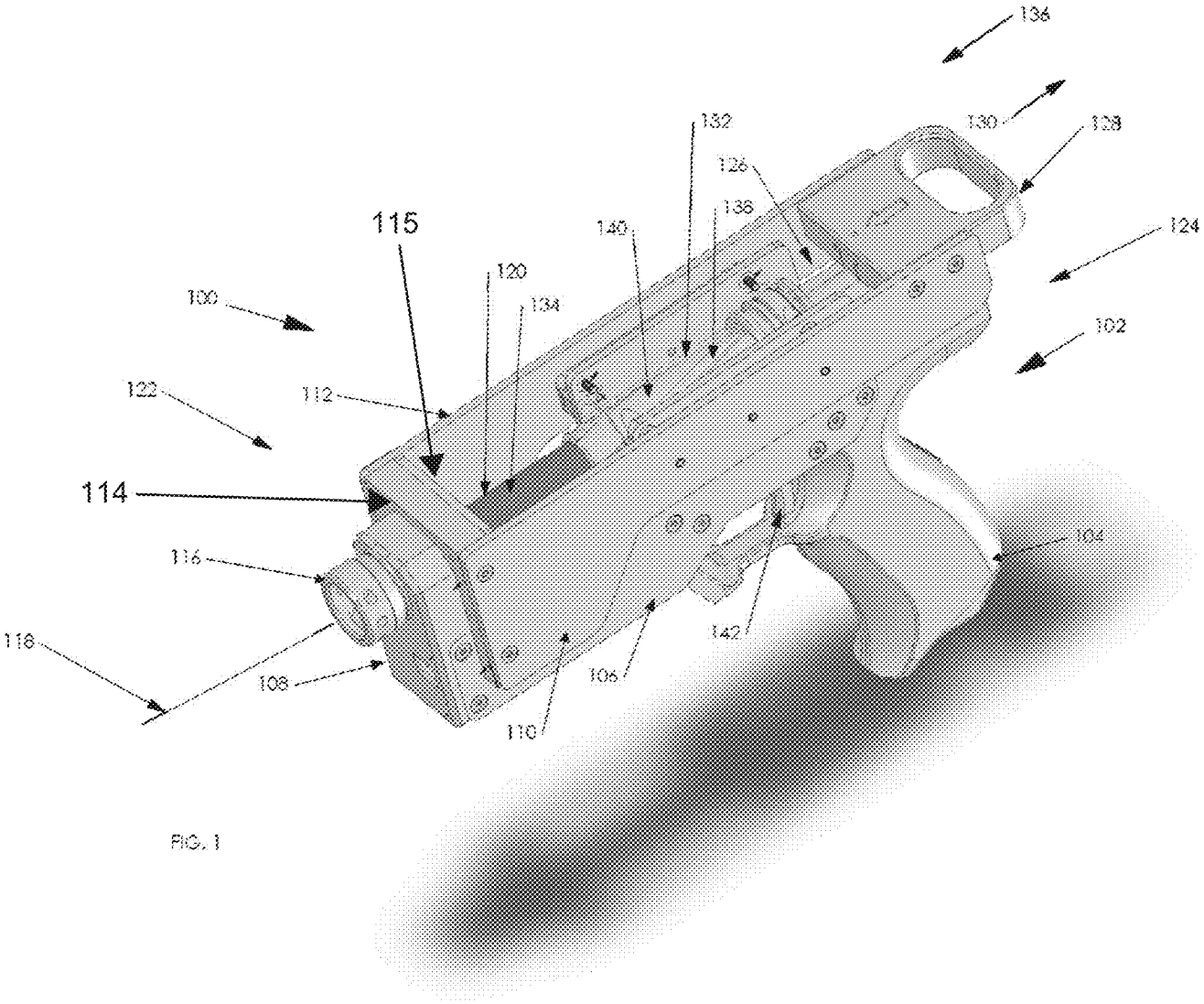
FIG. 1 illustrates an example air launch apparatus of the present disclosure.
Figure 2:
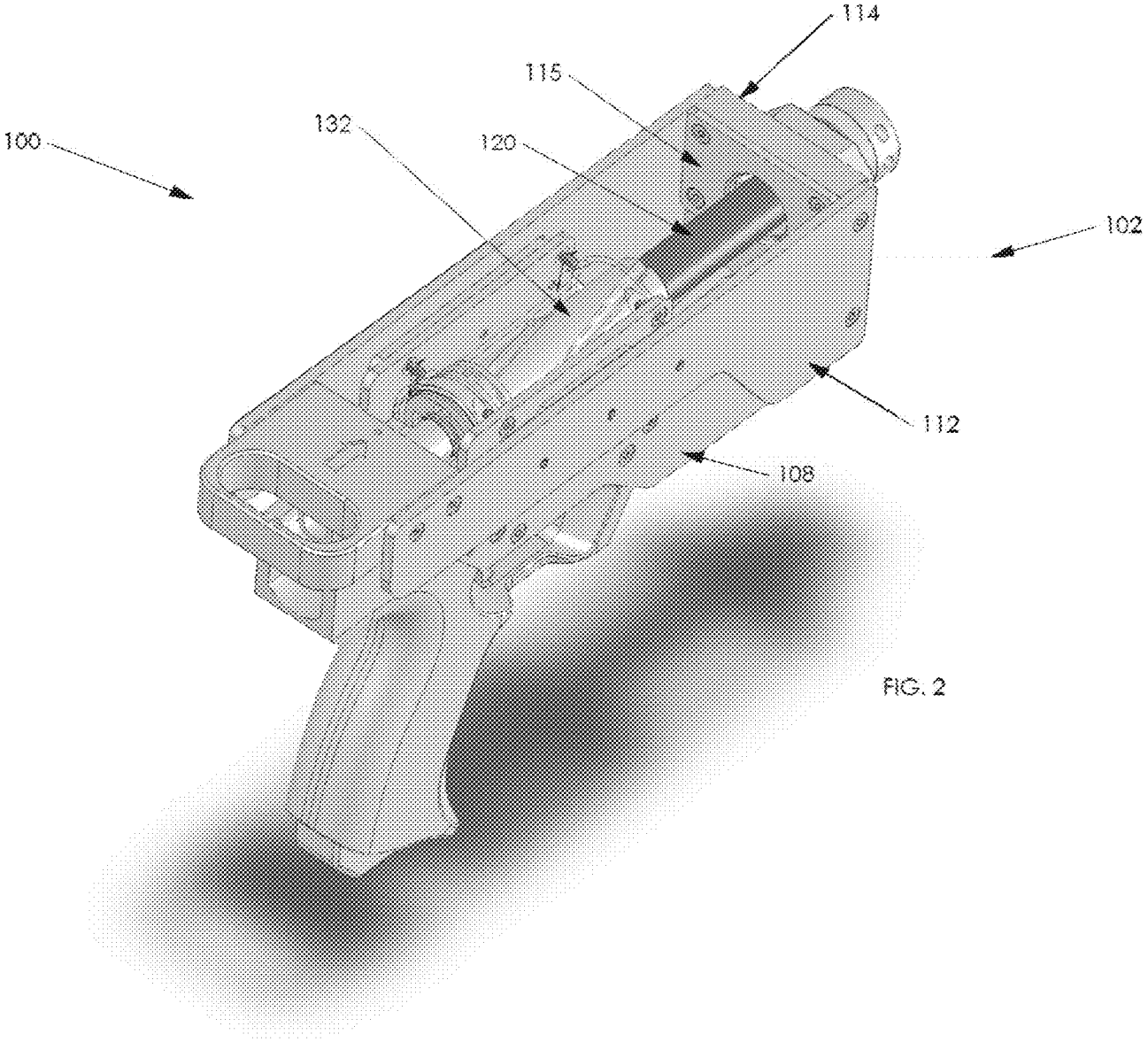
FIG. 2 illustrates another view of the example air launch apparatus shown in FIG. 1.

FIGS. 1-4 illustrate an example air launch apparatus 100 of the present disclosure. Such an air launch apparatus 100 may include, for example, a substantially rigid frame 102. In some examples, the frame 102 may be formed from plastics or other polymers that are molded into a desired shape. In other examples, one or more components of the frame 102 may be made from one or more metals such as aluminum, steel, and/or other alloys. In such examples, the frame 102 may include a grip 104 configured to be held by the hand of an operator or other user of the air launch apparatus 100. The frame 102 may also include one or more additional components configured to form a substantially enclosed interior compartment of the air launch apparatus 100. For example, the frame 102 may include a first side wall 106 and a second side wall 108 disposed opposite the first side wall 106. In such examples, the first and second sidewalls 106, 108 may be fixedly mounted and/or otherwise fixedly coupled to the grip 104. In additional examples, the grip 104, first side wall 106, and second side wall 108, may be integrally formed from a single piece of material. In some examples, the grip 104, first sidewall 106, and second sidewall 108 may comprise a subframe or subassembly of the air launch apparatus 100, and in such examples, any of the other components described with respect to FIGS. 1-14 may be fixed, moveably mounted, and/or otherwise operably connected to one or more of the grip 104, first sidewall 106, and second sidewall 108. In some examples, the frame 102 may further include a third side wall 110 disposed adjacent to and/or in contact with the first side wall 106. The frame 102 may also include a fourth side wall 112 disposed adjacent to and/or in contact with the second side wall 108. In such examples, the third side wall 110 may be disposed opposite the fourth side wall 112.

In any of the examples described herein, the frame 102 and/or the subframe or subassembly described above may further include a front block 114 fixedly connected to the third side wall 110 and the fourth side wall 112. In such examples, the third and fourth sidewalls 110, 112 may comprise substantially planar, substantially rigid plates that are movable along the first and second sidewalls 106, 108, respectively in order to facilitate cocking of the air launch apparatus 100. Additionally, the front block 114 may comprise a substantially rigid plate or other piece of material configured to provide structural support to the third and fourth sidewalls 110, 112 during movement thereof relative to the first and second sidewalls 106, 108. It is understood that movement of the third and fourth sidewalls 110, 112 may cause commensurate movement of the front block 114. As can be seen in at least FIG. 2, the air launch apparatus 102 may also include a front plate 115 fixedly mounted to the front block 114. The front plate 115 may assist in retaining a latch and a nut of the air launch apparatus 100, and the latch may be configured to assist in restricting or permitting rotation of the nut. In such examples, the nut and the latch may be disposed within respective compartments formed by the front block 114 and, thus, are not clearly visible in FIG. 2. Additionally, the front plate 115 may mate with a spring or other resistance component (not shown) of the air launch apparatus 100. Such a resistance component may be disposed between the front plate 115 and, for example, a plunger (FIG. 3) of the air launch apparatus 100. Movement of the front block 114 toward the plunger may compress the resistance component, thereby causing energy to be stored by the resistance component. During firing of the air launch apparatus 100, the resistance component may expand, thereby causing such stored energy to be released. In such examples, the resistance component may drive the plunger away from the front block 114 during firing of the air launch apparatus 100. For example, the resistance component may drive the plunger and/or one or more components fixed to the plunger away from the front block 114 during firing of the air launch apparatus 100.

With continued reference to FIG. 1, the example air launch apparatus 100 also includes an exit port 116 configured to permit one or more foam darts, pellets, rounds of ammunition, and/or other projectiles to be ejected from the air launch apparatus 100 downrange. It is understood that such projectiles may be directed, by the air launch apparatus 100 to impact a target downrange via the exit port 116, and the exit port 116 may be configured to eject such projectiles substantially along the longitudinal axis 118 extending substantially centrally through an opening of the exit port 116. In any of the examples described herein, the air launch apparatus 100 may also include a substantially cylindrical, substantially hollow barrel 120. In such examples, the longitudinal axis 118 may comprise a longitudinal axis of the barrel 120, and may extend substantially centrally through a central channel defined by the barrel 120. The barrel 120 may comprise a substantially rigid, substantially cylindrical structure made from plastics, polymers, metals, and/or alloys, and the barrel 120 may be configured to direct a projectile, along the longitudinal axis 118, to the front block 114 and/or the exit port 116. For example, the barrel 120 may be fixed relative to the first sidewall 106, the second sidewall 108, and/or other components of the frame 102. In some examples, the barrel 120 may be fixedly mounted to, for example, a port block 302 (FIG. 3) of the air launch apparatus 100, and the port block 302 may be formed integrally with and/or otherwise fixedly connected to first sidewall 106, the second sidewall 108, and/or other components of the frame 102. In such examples, the exit port 116 may also be fixedly mounted to the port block 302 at a front end 122 of the air launch apparatus 100. As shown in FIG. 1, the front end 122 may be disposed opposite a rear end 124 of the air launch apparatus 100.

In some examples, the frame 102 of the air launch apparatus 100 may define one or more chambers 126 or other internal spaces configured to store pressurized gas, receive one or more foam darts or other projectiles, and/or to facilitate the movement of air launch apparatus components relative to one or more stationary components of the frame 102. It is understood that one or more components of the air launch apparatus 100 may form and/or may be disposed at least partially within the chamber 126. For example, the chamber 126 may be formed, at least in part, by the first sidewall 106, the second sidewall 108, the third sidewall 110, and/or the fourth sidewall 112. Further, components such as the piston 132, barrel 120, plunger, and/or other components described herein may be disposed, at least in part, within the chamber 126. In some examples, the chamber 126 and/or one or more components of the air launch apparatus 100 disposed in the chamber 126 may be configured to receive one or more foam darts as the air launch apparatus 100 is cocked. In such examples, the air launch apparatus 100 may also include a loading block 128 fixedly connected to the third and fourth sidewalls 110, 112. The loading block 128 may be disposed opposite the front block 114. Similar to the front block 114, the loading block 128 may be movable with the third and fourth sidewalls 110, 112, and relative to the first and second sidewalls 106, 108. In such examples, the loading block 128 may include one or more handles, grips, extensions, and/or other components configured to enable the user to move the loading block 128 against the force of the spring or other resistance component of the air launch apparatus 100 described above (not shown in FIG. 1) in order to cock the air launch apparatus 100. For example, the loading block 128 may be movable in the direction 130 against the force the resistance component of the air launch apparatus 100 during a cocking process. In such examples, movement of the loading block 128 in the direction 130 may cause commensurate movement of the third and fourth sidewalls 110, 112, and the front block 114, together with the loading block 128, in the direction 130. Additionally, such movement may compress the spring or other resistance component between the front plate 115 and a plunger 322 (FIG. 3) fixedly connected to a substantially rigid, substantially cylindrical piston 132 of the air launch apparatus 100.

Similar to the barrel 120, the piston 132 may be made from any substantially rigid material such as plastics, polymers, metals, alloys, and/or other materials. In any of the examples described herein, the piston 132 may be disposed substantially concentric with the barrel 120. For example, the piston 132 may be disposed about an outer surface 134 of the barrel 120, and may be movable along the outer surface 134 during the cocking and/or firing process. For example, during the cocking process, the front block 114 may be drawn toward the user in the direction 130 to compress the resistance component and so that the nut described above may engage the piston 132. Once so engaged, the user may then move the front block 114 in the direction 136, and the piston 132 (now fixedly engaged with the nut) may move with the front block 114 in the direction 136 and along the outer surface 134 of the stationary barrel 120. During a subsequent firing process, the user may disengage the nut from the piston 132, thereby enabling the piston 132 to move in the direction 130, along the outer surface 134 of the stationary barrel 120 and relative to the front block 114, under the force of the compressed resistance component. It is understood that the longitudinal axis 118 may extend substantially centrally through a central passage of the piston 132, and the piston 132 may be configured to move in directions substantially parallel to the longitudinal axis 118.

As shown in FIG. 1, an outer surface 140 of the piston 132 may define one or more grooves 138. In some examples, such grooves 138 may extend from a first end of the piston 132 to a second end of the piston 132 opposite the first end. In other examples, such groves may extend only along a partial length of the outer surface 140. As can be seen in at least FIG. 3, one or more of the grooves 138 may extend substantially in a spiral, helical or corkscrew configuration about the outer surface 140. Such configuration may assist one or more components of the air launch apparatus 100 (e.g., the nut described above) with restricting movement of the piston 132 in some configurations. For example, a pitch, angle, or other configuration of one or more spiral, helical, or corkscrew grooves 138, relative to the longitudinal axis 118, may define the amount of force required to release the nut from the piston 132. With continued reference to FIG. 1, the air launch apparatus 100 may also include a trigger 142 disposed proximate the grip 104. The trigger 142 may be configured to move one or more such components of the air launch apparatus 100 relative to the piston 132 in order to assist in firing the air launch apparatus 100. For example, the trigger 142 may be configured to assist in moving a latch or other component of the air launch apparatus 100, thereby permitting movement of the nut described above, or other component disposed around the outer surface 140 of the piston 132 and engaged with one or more of the grooves 138. Movement of such components, as caused by actuation of the trigger 142 may, for example, cause the nut to disengage with the one or more grooves 138, thereby enabling movement of the piston 132 away from the front block 114 in the direction 130 during firing of the air launch apparatus 100. An example nut and latch configuration of the present disclosure will be described in greater detail below with respect to at least FIG. 3.

Figure 3:
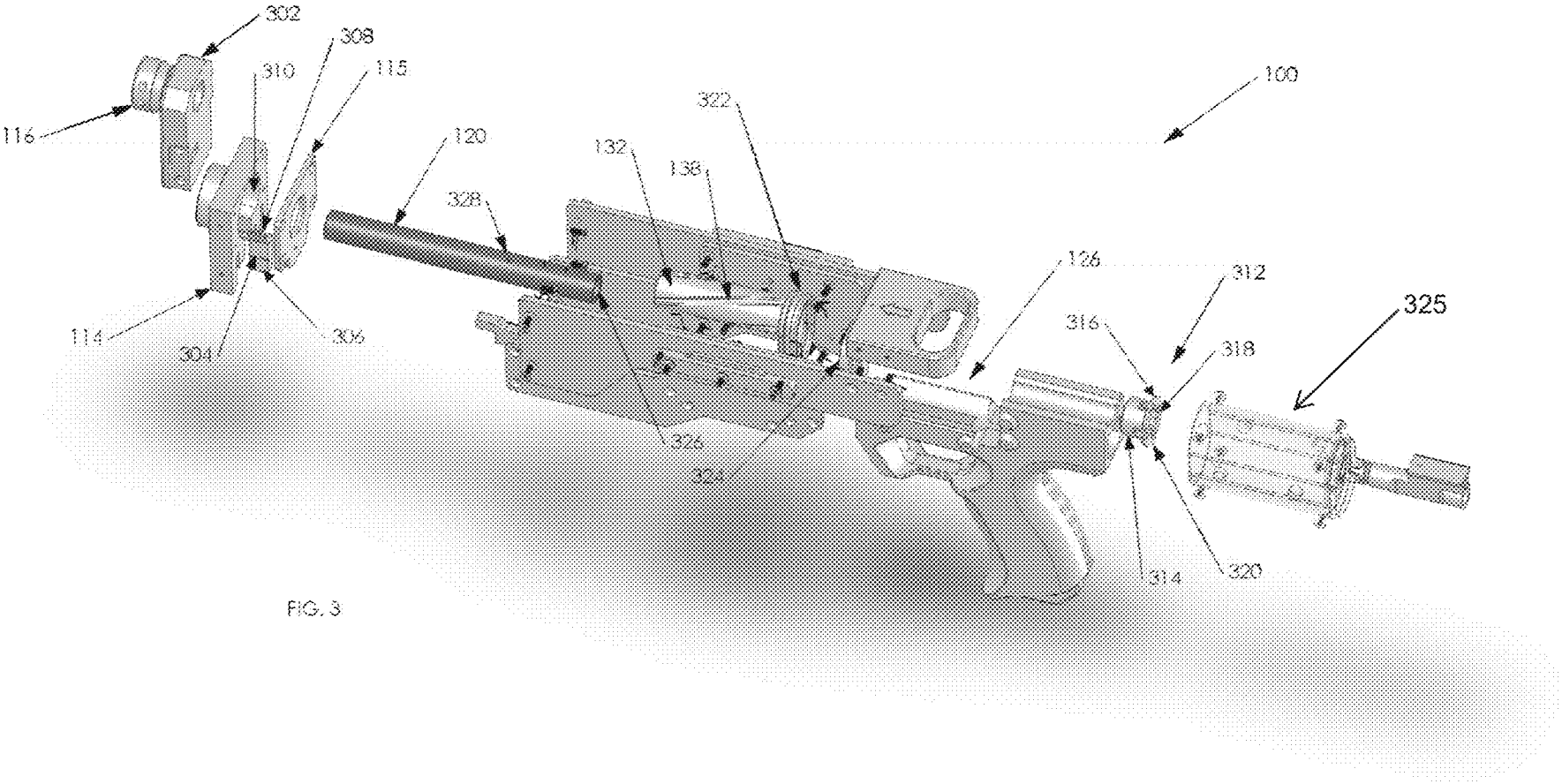
FIG. 3 illustrates an exploded view of the example air launch apparatus shown in FIG. 1.
Figure 4:
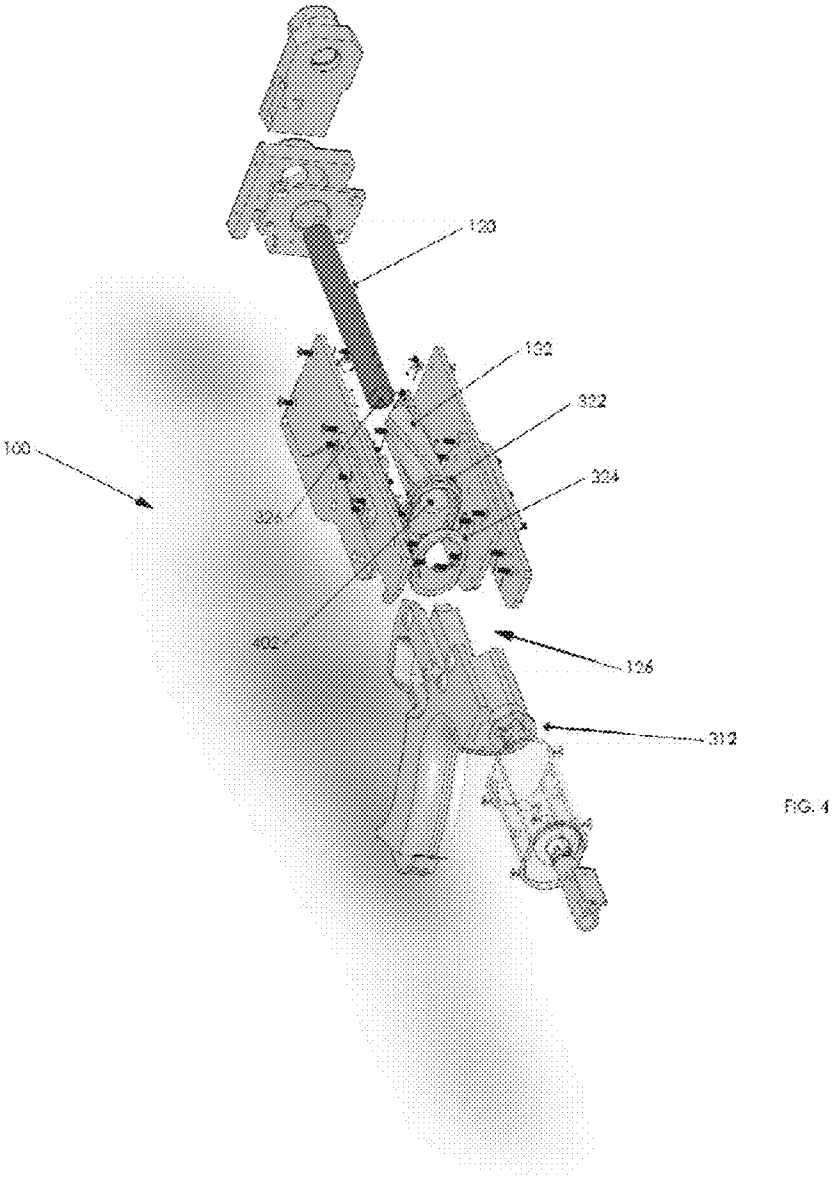
FIG. 4 illustrates another exploded view of the example air launch apparatus shown in FIG. 1.

As can best be seen in at least the exploded views shown in FIGS. 3 and 4, the example air launch apparatus 100 may further include a port block 302 disposed at the front end 122 of the air launch apparatus 100. In such examples, the exit port 116 may be fixedly coupled to the port block 302. Additionally, the port block 302 may be fixedly coupled to the first side wall 106 and the second sidewall 108. In such a configuration, the front block 114 may be movable relative to the port block 302 during cocking of the air launch apparatus 100.

The air launch apparatus 100 may also include a latch 304 that is pivotably mounted to the front block 114 and/or to the front plate 115. In such examples, latch 304 may be rotatable and/or pivotable relative to the front block 114, and may be disposed within an interior chamber or other interior space of the front block 114 configured to permit limited movement of the latch 304 relative thereto. As can be seen in at least FIG. 3, an example latch 304 may include a base 306, and an arm 308 or other such extension. In such examples, latch 304 may be mounted to the front block 114 such that the arm 308 may extend at least partly into a channel 310 defined by the front block 114.

As noted above, the air launch apparatus 100 may also include a nut 312 configured to engage with the piston 132, and in some examples, the nut 312 may be disposed within the channel 310 of the front block or 114. The nut 312 may comprise a substantially cylindrical, substantially hollow structure configured to engage with the one or more grooves 138 of the piston 132, in order to restrict movement of the piston 132 relative to, for example, the front block 114. For example, the nut 312 may include a substantially cylindrical, substantially hollow body 314, and an annular flange 316 extending radially outwardly from the substantially cylindrical body 314. In use, at least part of the body 314 may be disposed within the channel 310 of the front block 114. Additionally, the nut 312 may include one or more detents 318 extending radially inwardly from a substantially cylindrical inner surface and/or central passage of the nut 312. Such detents 318 may engage with and/or be at least partly disposed within respective grooves 138 of the piston 132. Additionally, the flange 316 may define one or more notches 320 configured to engage with the arm 308 of the latch 304. In this way, when the arm 308 of the latch 304 is engaged with and/or at least partly disposed within the notch 320 of the nut 312, rotation of the nut 312 relative to the front block 114 will be prohibited by such engagement. Additionally, the engagement between the detents 318 of the nut 312 and the grooves 138 of the piston 132 will prohibit movement of the piston 132 relative to the front block 114. In particular, during cocking of the air launch apparatus 100, the front block 114 may be drawn rearward in the direction 130, and the nut 312 may rotate such that the one or more detents 318 engage the respective grooves 138 of the piston 132. Additionally, engagement between the latch 304 and the notch 320 may prohibit further rotation of the nut 312. Once the detents 318 are engaged with the respective grooves 138, and the latch 304 is engaged with the notch 320 to restrict further rotation of the nut 312, the piston may be temporarily fixedly coupled to the nut 312. In such examples, movement of the nut 312 in the direction 136, together with the front block 114 as part of the cocking process, may cause commensurate movement of the piston 132, together with the front block 114, in the direction 136. On the other hand, rotation of the latch 304 relative to the front block 114 such that the arm 308 disengages the notch 320 of the flange 316 316, permits that nut 312 to rotate within the channel 310 of the front block 14. Such rotation of the nut 312 also permits movement of the piston 312, relative to the barrel 120 and relative to the front block 114, in the direction 130 during firing of the air launch apparatus 100.

With continued reference to FIGS. 3 and 4 and as noted above, the example air launch apparatus 100 also includes a plunger 322 that is fixedly coupled to an end of the piston 132. The plunger 322 may comprise a substantially rigid plate and/or other structure configured to form a substantially fluid tight seal with a substantially hollow air chamber 325 (shown in phantom in FIG. 3) of the air launch apparatus 100. For example, the air chamber 325 may comprise a substantially rigid structure disposed within the chamber 126 of the air launch apparatus 100. The air chamber 325 may define an internal space within which air or other gases may be disposed. The plunger 322 may be disposed at least partly within the internal space of the air chamber 325 and may form a substantially fluid tight seal with the internal surface. The plunger 322 may also be moveable within the internal space and relative to the air chamber 325 during the cocking and firing process. For example, movement of the plunger 322 in the direction 136 (FIG. 1) during cocking may draw air into the internal space of the air chamber 325. Such air may be disposed between the plunger, and a cap 324 coupled to the air chamber 325 and disposed opposite the plunger 322. In such examples, air or other such fluids may be retained within the internal space of the air chamber 325 between the plunger 322 and the cap 324, and such fluids may be used to direct a foam dart and/or other projectile to pass through a central passage 326 of the barrel 120 in the direction 136, and to be ejected from the air launch apparatus 100 via the exit port 116. For example, during the firing process, the plunger 322 may be urged in the direction 130 by the spring or other resistance component (not shown) described above. Movement of the plunger 322 in the direction 130 and within the air chamber 325 may cause the plunger 322 to force air disposed within the air chamber 325 to impinge upon the cap 324. Such air may move in the direction 130 (i.e., toward the user) within the air chamber 325. The air impinging upon and/or to otherwise be directed by the cap 324 may be caused to reverse directions and may be forced to enter the barrel 120 (e.g., via one or more passages of the air launch apparatus fluidly connecting the air chamber 325 with the barrel 120) by passing in the direction 136. The air entering the barrel 120 from the air chamber 325 and passing in the direction 136, may impinge upon a foam dart or other such projectile disposed at least partly within the barrel 120 during the cocking process. As the plunger 322 is urged in the direction 130 during the firing process, the air moving from the air chamber 325 to the barrel 120 as a result of such plunger motion may eject the projectile from the barrel 120, in the direction 136. In such examples, at least part of the pressurized air may escape through one or more release ports 328 and/or other through holes formed in the barrel 120. It is understood that at least part of the barrel 120 may be disposed within a central passage 402 of the piston 132 during operation of the air launch apparatus 100. Accordingly, in any of the examples described herein one or more projectiles fired by the air launch apparatus 100 may pass, at least in part, through the central passage 402 of the piston 132. Further, it is understood that the air launch apparatus 100 may include a bolt (shown in FIG. 3 adjacent to the air chamber 325, but not labeled) configured to assist in loading the projectile into the barrel 120 during the cocking process and/or to form a substantially fluid-tight seal with at least part of the air chamber 325, the plunger 322, and/or the piston 132.

Figure 5:
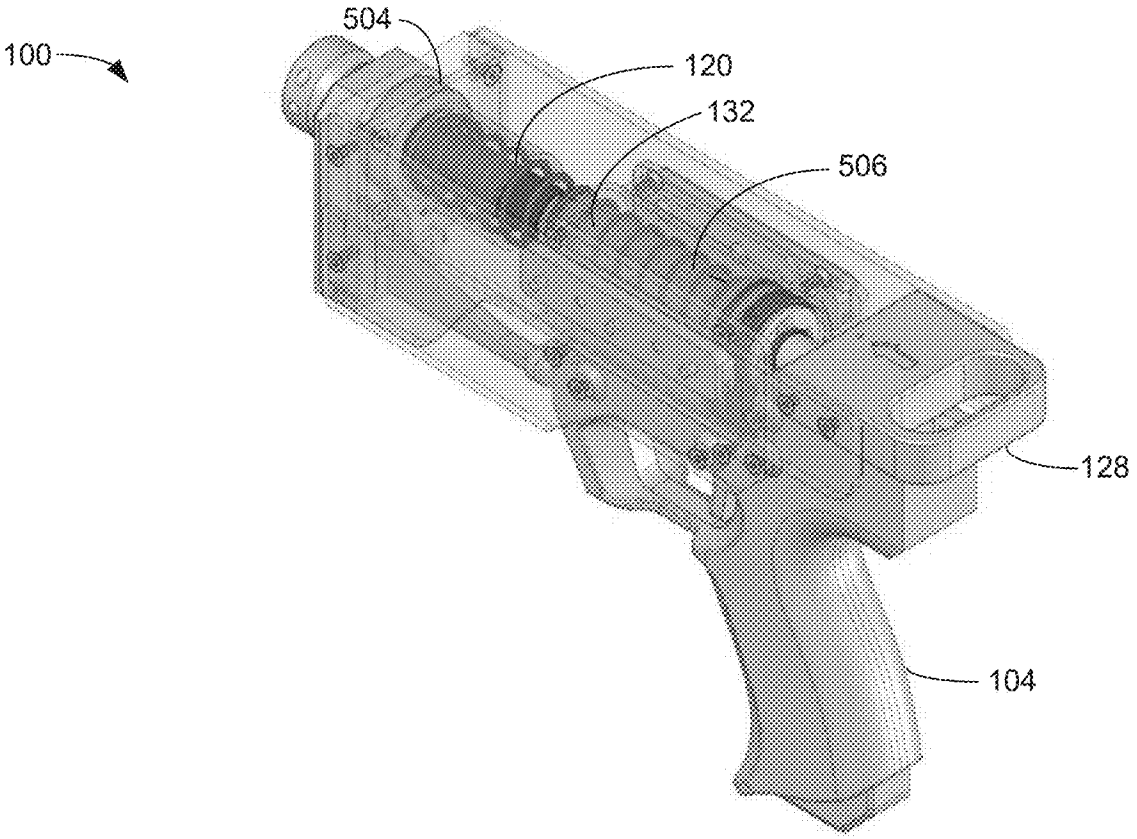
FIG. 5 illustrates an example of an air launch apparatus in an un-cocked configuration and having a spring biasing mechanism for biasing a piston into an air chamber.

FIG. 5 illustrates a perspective view of the air launch apparatus 100 in an un-cocked configuration. The air launch apparatus 100 includes a biasing mechanism for biasing the piston 132 away from the front of the air launch apparatus 100 and into an air chamber (not shown in FIG. 5). In one embodiment, the biasing mechanism can be a spring and will be referred to herein as a spring 502 although other biasing mechanisms could be used as well. The spring 502 surrounds the barrel 120 and piston 132, and in one embodiment can be concentric with the barrel 120 and piston 132. The air launch apparatus 100 includes the nut 312 that is configured with inward protruding detents configured to mate with one or more helical grooves 138 formed in the outer surface of the piston 132.

In this configuration, the spring 502 is at the installed length, the piston 132 is fully to the rear and no projectile is loaded. The spring 502 is concentric with the barrel and the piston 132 and extends into the cylinder. This is a very compact package.

Figure 6:
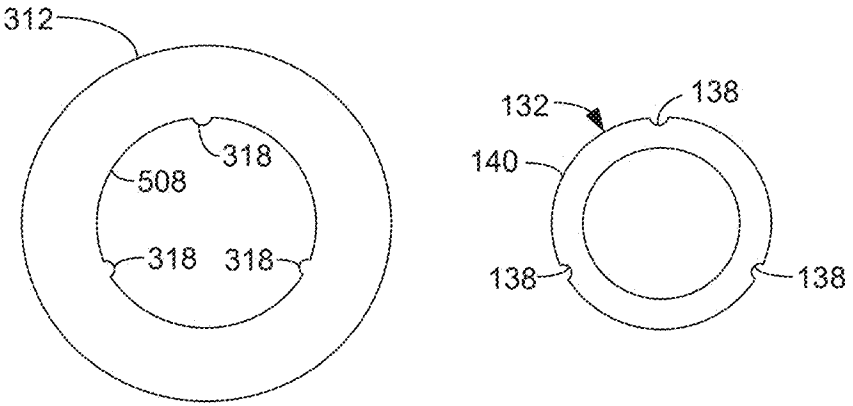
FIG. 6 illustrates an example of the air launch apparatus shown in FIG. 5 in a half-cocked configuration.

FIG. 6 shows an end view of the nut 312 and the piston 132. The nut 312 has an inner diameter 508, that is configured with the inward extending tabs or detents 318. The piston 132 has an outer surface 140 that is configured with the previously described inward extending helical groove 138. The detents 318 of the nut 312 are configured to mate with the helical groove 138 of the piston 132 when the nut 312 engages the outer surface 512 of the piston 132.

The spring 502 is now compressed, and the catch has now engaged the end of the piston via the helical grooves 138. This is a stable state, the spring force is now being held by the catch and the user no longer has to hold the slide or cocking handle 128. The action is open and the bolt is to the rear. In a design with a magazine (not shown), the dart would be at the top of the magazine and would be ready to be loaded into the chamber.

Figure 7:
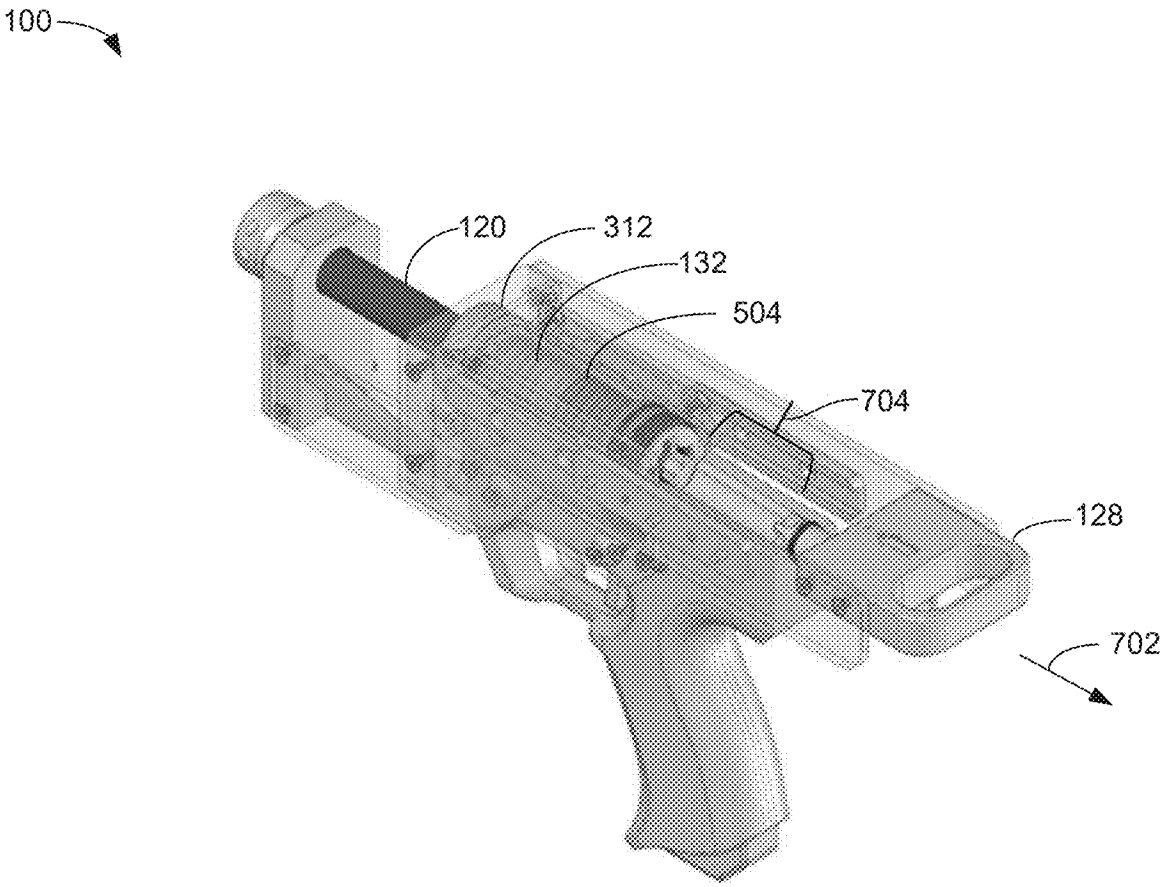
FIG. 7 illustrates the air launch apparatus as shown in FIGS. 5 and 6 in a fully cocked configuration.

FIG. 7 illustrates the air launch apparatus 100 in a half-cocked configuration. A when a user pulls on the loading block 128 in the direction indicated by arrow 702, the frame formed by the sidewalls 110 112 and front plate 115 pull back the nut 312, compressing the spring 504. In addition, a space 704 is formed wherein a projectile (not shown) such as a foam dart can be inserted. The nut 312 will engage and lock to the outer surface of the piston 132 in a manner that will be described in greater detail herein below.

In this configuration, the dart has been chambered, and the slide or cocking handle 128 has been moved back to the initial position. The piston 132 has been pulled forward with the compressed spring, the bolt is in battery and sealed and the device is ready to fire. Pulling the trigger will allow the catch to release. The catch wants to rotate under the spring load but is prevented by the sear (e.g., latch 304 FIG. 9). Pulling the trigger allows latch 304 to move, allowing the catch to release. Once the catch is released, the piston accelerates rear-ward and compresses/moves the air inside the air chamber to the rear where it is turned around and passed through the barrel in order to propel the projectile out of the barrel.

Figure 8:
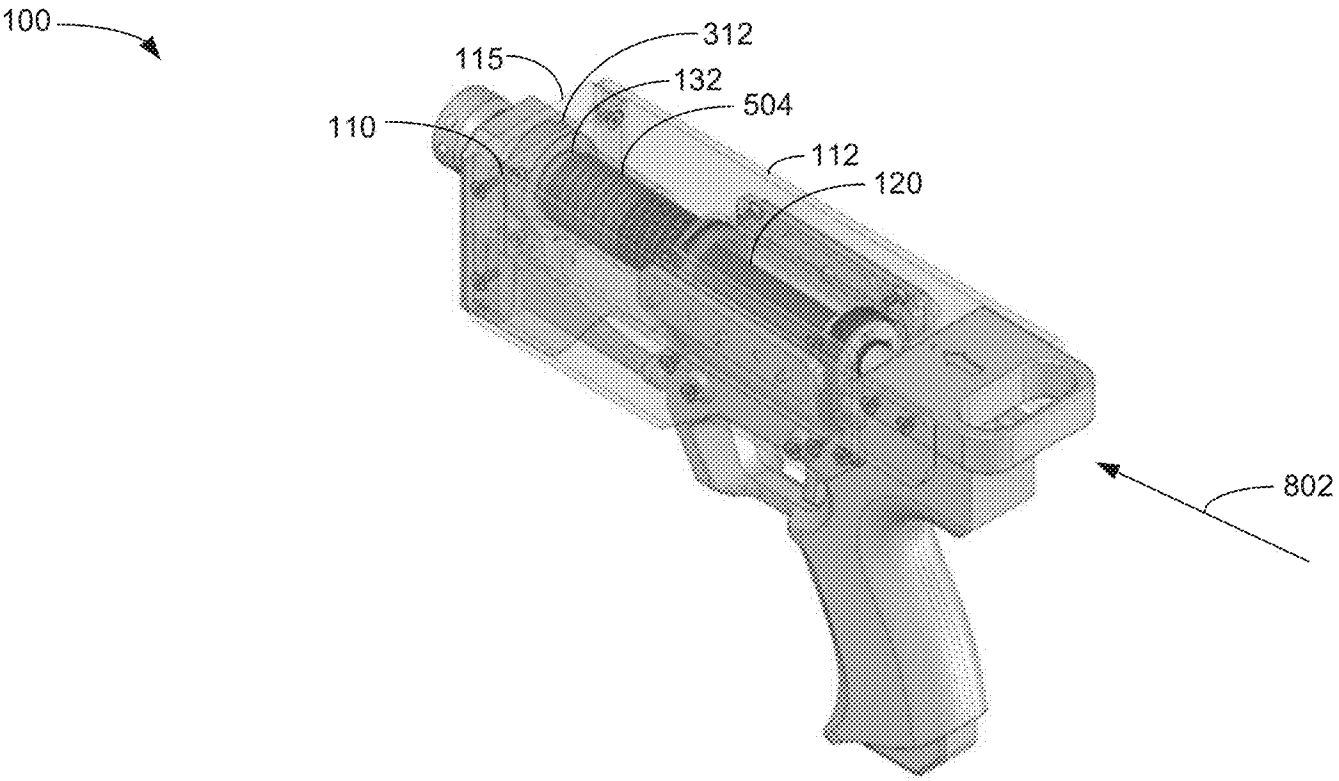
FIG. 8 illustrates an air chamber, piston and biasing spring with the spring compressed prior to firing.

With reference now to FIG. 8, the loading block 128 is pushed forward as indicated by arrow 802. This loads the projectile (not shown) into the barrel 120. This also moves the compressed spring 504, piston 132, front plate 115, and nut 312, as well as the third and fourth sidewalls 110, 112 forward.

Figure 9:
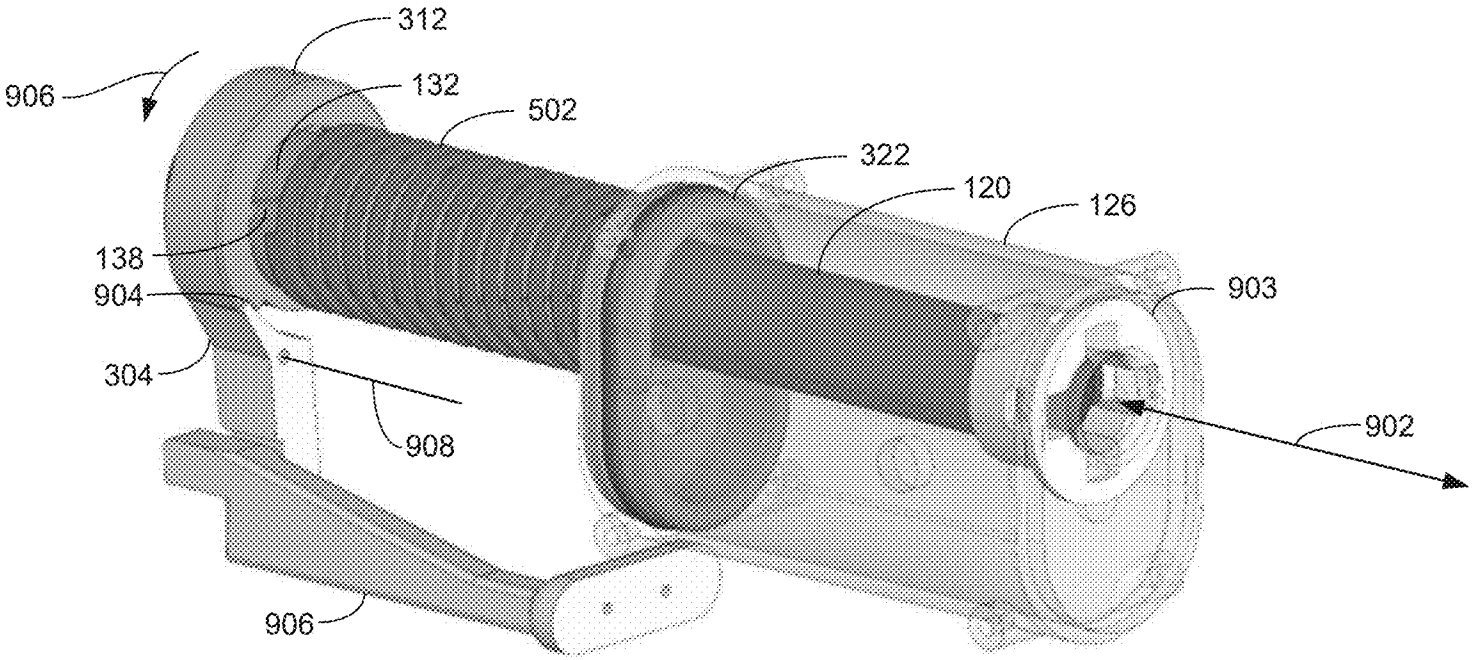
FIG. 9 illustrates a cross-section of a barrel, piston, and air chamber of an air launch apparatus prior to firing.

FIG. 9 shows a piston and air chamber assembly 902 in a fully cocked configuration. The assembly 902 is shown enlarged to more clearly illustrate the components thereof relative to one another. The assembly 902 includes the nut 312, piston 132, spring 502, barrel 120, an air chamber 126, and a bumper 903 at a back end of the air chamber 126. The piston 132 is connected with the plunger 322 in such a manner that the piston 132 can rotate relative to the plunger 322. The plunger 322 is configured to form a substantially air-tight seal between with an inner surface of the air chamber 126, while also being able to slide within the air chamber 126 along a longitudinal axis 902 defined by the barrel 120.

The nut 312 can have one or more notches 904 formed on its outer surface, the notches 904 being configured to engage the latch 304. Force from the compressed spring 502 biases the nut 312 in a rotational direction due to the sliding engagement of the nut 312 with the helical groove 138 of the piston 132. In the case shown in FIG. 9, the force from the compressed spring 502 biases the nut 312 in a direction as indicated by arrow 906. This also biases the notch 904 of the nut 312 against the latch 904, which temporarily limits movement of the nut 312. The engagement of the latch 904 against the notch 904 of the nut 312 prevents rotation of the nut 312 relative to the piston 132. Because the nut 312 is slidably engaged with the groove 138 of the piston 132, limiting rotational movement of the nut 312 also limits movement of the nut in the longitudinal direction relative to the longitudinal axis 902.

The latch 304 can be engaged with a lever 906, which can be controlled by the trigger 142 (FIG. 1). The latch 304 can pivot about an axis 908. Movement of the lever 906 can move the latch 304 out of engagement with the notch 904 of the nut 312, thereby allowing the nut 312 to freely rotate. The nut 312 moves under the force of the spring 502, however, the location of the nut 312 is fixed relative to the longitudinal axis 902, such as by its connection with the front block 114 and front plate 115 (FIG. 3). By allowing the nut 312 to freely rotate, the spring 502 pushes the piston 132 and plunger 322 into the air chamber 126 (to the right in FIG. 9), due to the force of the compressed spring 502. This movement of the piston 132 and plunger 322 into the air chamber 126 compresses air within the chamber. The compressed air within the chamber can flow through air ducts 908 formed in the bumper 903 to allow compressed air to flow into the back end of the barrel 120 to force projectile within the barrel (not shown in FIG. 9) out of the front of the barrel 120. Therefore, air flow into the barrel 120 flows in a direction opposite to the direction of travel of the piston 132 and plunger 322.

It is worth noting that the helical groove 138 has a pitch angle as measured relative to the longitudinal axis 902 such that the main spring force is split so that rotational force on the latch is at a minimum for operation and the latch only has to support this small component of the main force in order to hold the piston back. In embodiments the shallow pitch angle can be less than about 45 degrees to the axis. This shallow angle reduces friction between the nut 312 and the piston 132 when the piston 132 is being moved into the air chamber 126 under force of the compressed spring 502. In some examples, the helical groove 138 defines a pitch angle of less than 20 degrees relative to the longitudinal axis 902. In one embodiment, the pitch angle of the helical groove 138 can be chosen such that the latch (which can be constructed of a polymer) could support the tangential component of the load without failing. Since this is the force that has to be overcome when pulling the trigger, it is also chosen based on having a reasonable trigger pull force. For example, a trigger force of 1 lbf would be too light and too easy to fire, while a trigger force of, for example, 10 lbf would be too great. In one embodiment, a trigger force of 4-5 lbf would be acceptable.

The helical mating features in the catch and the piston work to hold back the spring force. The piston can translate, but not rotate. The catch can both translate and rotate. The features (male or female) can be swapped between the nut and piston. The shared helix angle can also change. The features must be large enough to bear the loads created by the spring 502. The spring 502 acts linearly on the piston, but the angle of the helix causes a split in the forces on the catch. The forces may be split into a linear force acting along the axis of the spring, barrel and piston, and the tangential force acting around the axis of the barrel, spring and piston. The helix direction may be clock-wise or counter clock-wise, this would only change the location of the sear to whatever location is appropriate to oppose this tangential force. The sear (e.g., latch 304) blocks this rotation. The faces that the sear acts on can be made suitably large that the associated force is spread over a large area and reduces the face pressure such that common molded plastic materials can handle the pressure without excessive wear, cracking or mechanical failure. The sear moves on an arc, and the sear faces are arranged as radial faces with the common center on the sear pivot access. This means that only friction must be overcome to move the sear and it does not change the position of the catch or do meaningful work. A roller can be placed at this sliding interface to lower friction further. Pulling the trigger moves the sear out of the blocking position so that the catch is now free to rotate under the tangential force. This rotation allows for the translation of the piston a small distance until it is free of the catch and then the piston moves only under the force of the linear spring force. The piston accelerates, compresses and displaces the air inside the air chamber 126 which is directed into the barrel 120 and used to propel the projectile. A light spring on the trigger can let the trigger reset. A light spring on the catch (latch 304) lets the catch reset. A light spring on the sear could allow it to reset into the blocking position when the device is again cocked. This is, however, only one possible embodiment, as rotation of a catch mechanism can be prevented in a variety of way wherein a trigger mechanism could be sued to un-block it.

The shallow angle of the helical groove can self-drive itself. The split of the forces is determined by this angle and trigonometry. More or less tangential force can be generated on the catch mechanism by changing this helix angle. The goal is to hold back a strong spring, split the force into a smaller, more manageable tangential force and then use the fire control system to hole and release that small force. This allows for the use of a high spring force while still using injection molded plastic parts.

Figure 10:
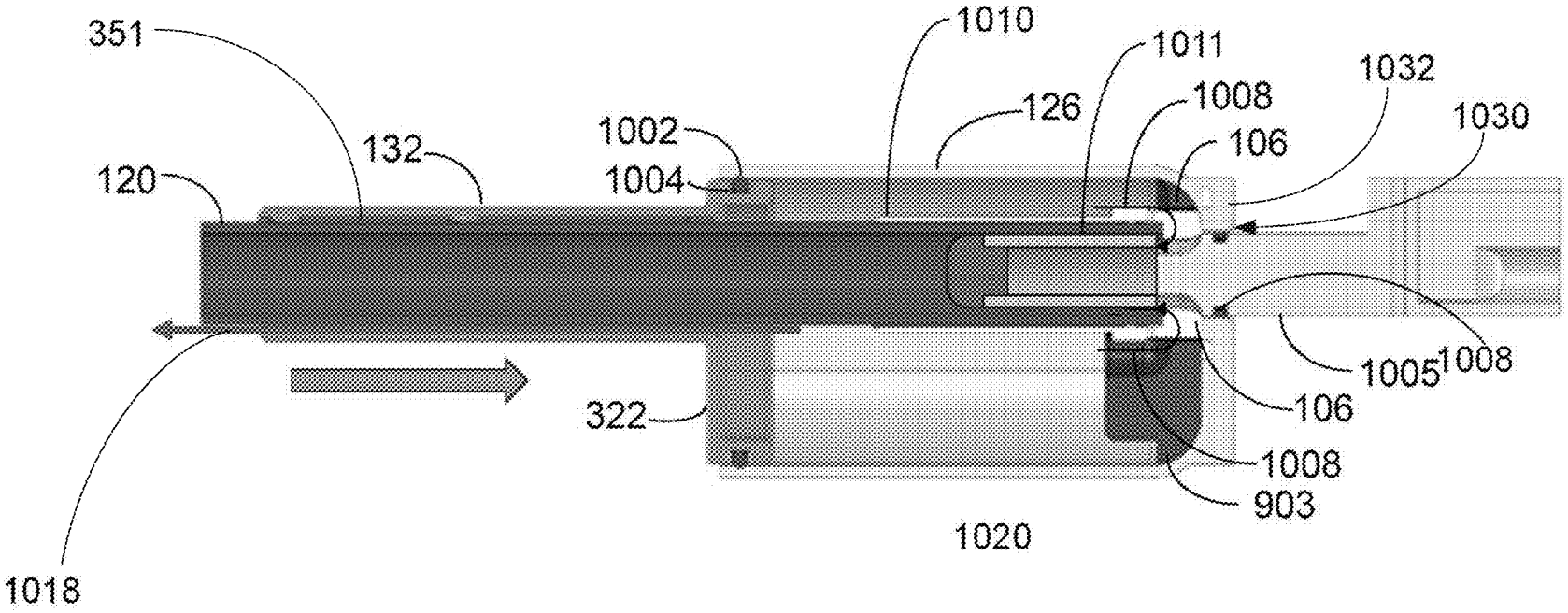
FIG. 10 illustrates a cross-section of the barrel, piston, and air chamber of the air launch apparatus after firing, with the piston only partially within the air chamber.
Figure 11:
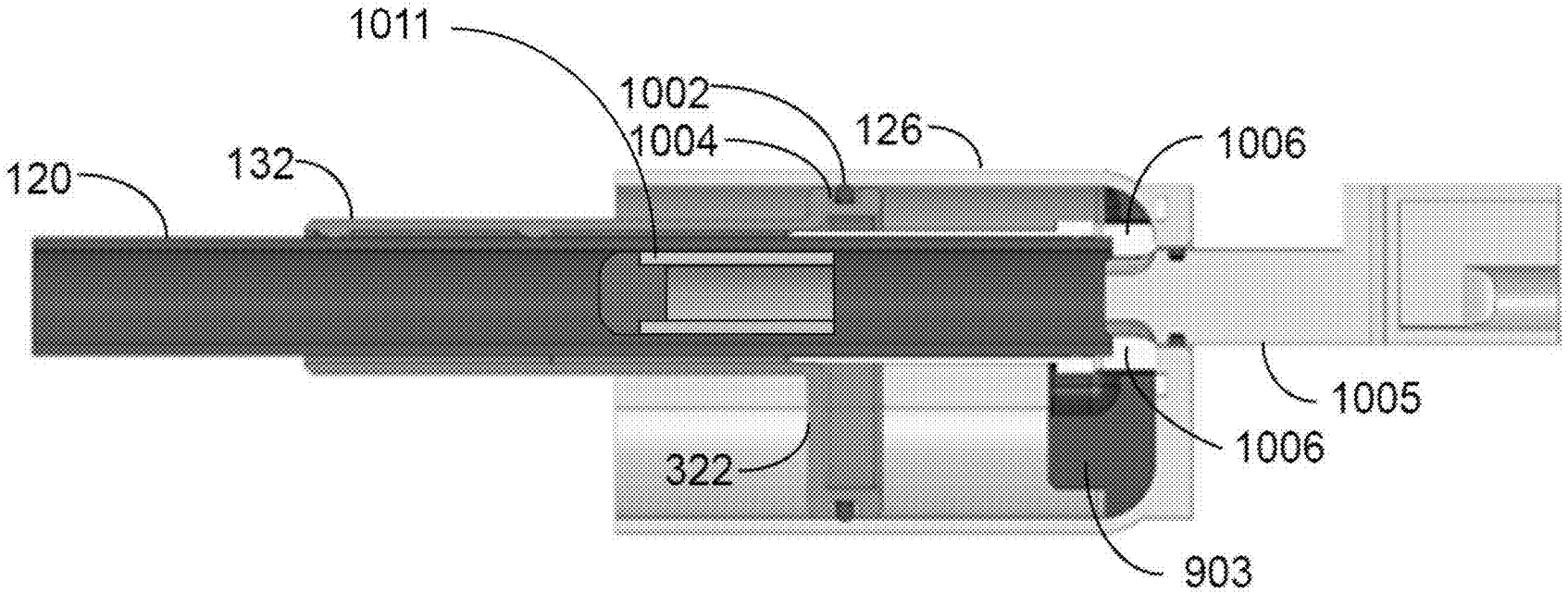
FIG. 11 illustrates a cross-section of the barrel, piston, and air chamber of the air launch apparatus after firing with the with the piston fully engaged within the air chamber.
Figure 12:
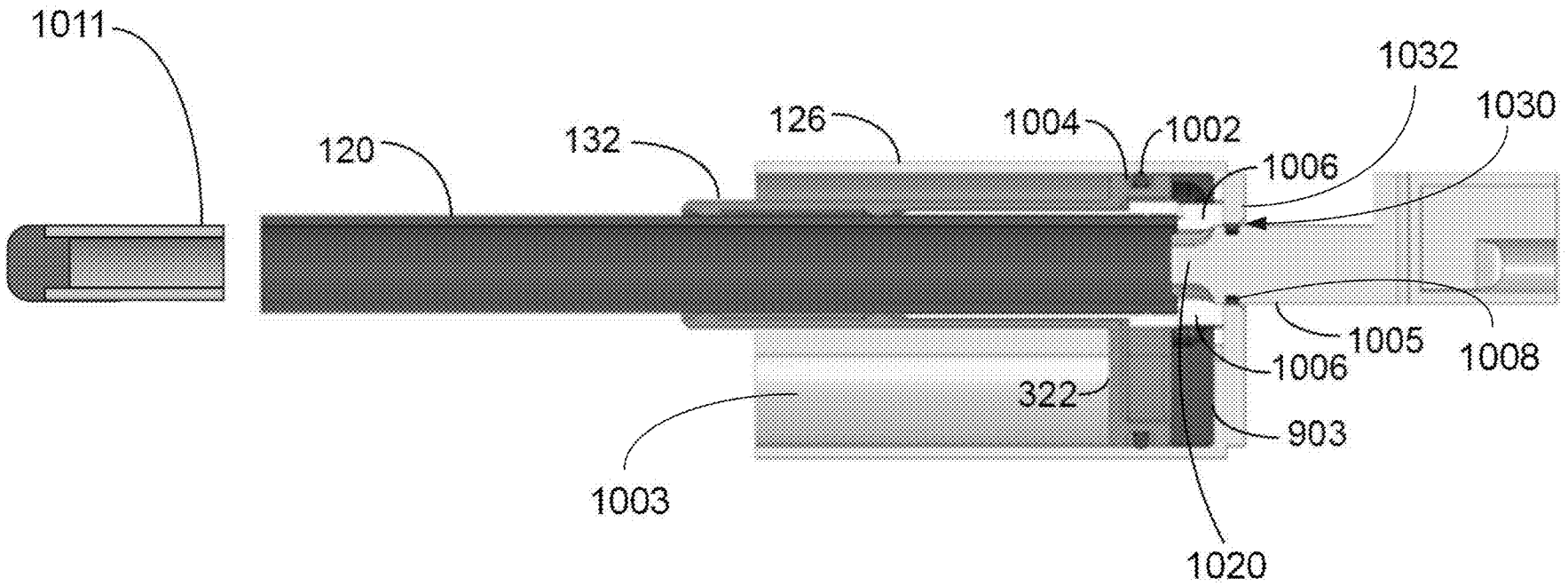
FIG. 12 illustrates a cross-section of the barrel, piston, and air chamber of the air launch apparatus having a projectile loaded within the barrel.

FIGS. 10-12 are cross sectional views of the barrel 120, piston 132, plunger 322 and air chamber 126 in stages of movement of the piston 132 and plunger 322 into the into the air chamber 126.

In FIG. 10, the piston 132 is positioned proximate the outer end of the air chamber 126 such as at an initial stage of firing a projectile 1011. The plunger 322 can have one or more o-rings 1002 at its outer periphery in order to engage the inner surface 1003 of the air chamber 126 in an air-tight, slidable manner. The outer periphery of the plunger 322 can be configured with one or more grooves 1004 to contain the one or more o-rings 1002.

A loader 1005 has a loading tip 1020 that is inserted into an opening 1030 in a back wall 1032 of the air chamber 126 and that is used, in embodiments, to position the projectile 1011 for firing. The loader 1005 can be moved out of engagement with the air chamber 126 (to the right in FIG. 10) in order to load a projectile 1011. The loader 1005 can then be used to push the projectile 1011 into the barrel 120. The plunger 1005 can include one or more o-rings 1008 to form an air-tight seal with the back end of the air chamber 126. The bumper 903 can be located at the back end of the air chamber 126. In one embodiment, the bumper 903 can be formed of a flexible material such as rubber or polymer to absorb the impact of the plunger 322.

In the embodiment illustrated, seal 106, air chamber 126, bumper 903 and the loading tip 1020 are configured to form an air duct 1006 behind the barrel 120 to allow air to flow from the air chamber 126 into the barrel 120 as indicated by lines 1008.

With continued reference to FIG. 10, a sleeve 1010 is configured to surround a portion of the barrel 120. The sleeve 1010 effectively increases the outer diameter of the barrel 120 for a portion of the travel of the plunger 322 and piston 132 into the air chamber 126. Piston 132 and plunger 322 define a interior channel 351 through which barrel 120 extends. As the plunger 322 and piston 132 initially move into the air chamber 126, the smaller diameter of the barrel 120 can allow a certain amount of air leakage 1018 between the piston 132 and the barrel 120.

In embodiments, interior channel 351 is oversized with respect to barrel 120 to provide sufficient air leakage between barrel 120 and interior channel 351 to limit the pressure applied through 106 against projectile 1011 to a level that enables projectile 1011 to remain within a preferred range of positions until interior channel 351 reaches sleeve 1010.

However, as shown in FIG. 11, when the piston 132 and plunger 322 reach the sleeve 1010, the increased diameter provided by the sleeve 1010 causes an air-tight seal between the interior channel 351 and the sleeve 1010. Further, movement of plunger 322 and piston 120 through air chamber 126, drives the large remaining volume of air in air chamber 126 to create a flow of air into the more constrained space of air duct 1006.

Air duct 1006 guides the flow of air so that the flow changes from a flow in the first direction into a flow in a second direction that flows into the back of the barrel 120 travels in a direction opposite to the direction of travel of the piston 120 and plunger 322. In embodiments, the air duct 1006 may be formed using different combinations of some or all of these and other components of the air launch apparatus.

Air duct 106 can be defined with a relatively smooth shape that is calculated to limit the extent of turbulent flow in air duct 106 to preserve a generally predetermined extent of the dynamic pressure of the flow. Once this flow is directed into barrel, the flow begins to work on the projectile 1011 starting to move the projectile 1011.

Any loss of dynamic pressure, turbulence, loss of momentum, or rapid changes in cross section through the air duct 106 will result in loss of energy. An efficient turnaround geometry will preserve as much energy as possible in order to propel the projectile to the highest speed possible. As shown, the air duct 106 forms a toroidal shape and works to smoothly turn the flow of air 180 degrees into the barrel 120. The bumper 903 occupies a lot of this space, but has channels molded into it to correspond to the apertures in the dart gate. These form the other portions of the same toroidal surface and help redirect the flow smoothly into the barrel 120. Removal of sharp edges prevents shearing of air flow. Gentle curves redirect the air flow without causing turbulence, minimizing loss of momentum. The bolt can be have a cruciform shape and can be otherwise relieved to allow for the passage of air.

This configuration advantageously improves performance by allowing the piston 132 and plunger 322 to gain velocity and momentum during initial travel without moving the projectile out of a preferred range of firing positions. As a result, the piston 120 and plunger 322 drive the remaining air in air cylinder 126 through air duct 1006 in a short period of time. This creates a dynamic flow against the back of projectile 1011 that significantly increases the pressure against the back of the projectile 1011 over a short period of time. This, in turn, causes a rapid acceleration of the projectile 1011 imparting a desired muzzle velocity to the projectile 1011 when, as shown in FIG. 12, projectile 1011 is fired from barrel 120. As is also shown in FIG. 12, the travel of the piston 120 and plunger 322 can terminate upon reaching the bumper 903.

Because the projectile moves at a low pressure, the peak theoretical pressure of the spring and air system is not reached. In order to increase the actual peak pressure, especially when using a short barrel 120, it can be useful to allow the piston to accelerate first without moving any are into the barrel. The above-described air leak path prior to the piston 132 engaging the sleave 1010 allows the piston 130 to accelerate first without moving any air into the barrel. As the piston 132 is fired to the rear, the air is displaced and leaks out through the leak path. The piston can then gain a large amount of momentum and kinetic energy before compressing air. The sleave 1010 can be part of a projectile gate component, having a lead-in and increases in diameter and provides a surface on which to seal. The location of these surfaces can determine how far the piston 132 travel, how much air is expelled before sealing, what speed it attains before sealing, and after sealing the remaining volume of air which the piston can work on. Because the piston 132 comes into contact with the seal 1010 while it is still accelerating and has a substantial velocity, it compresses the remaining air in the system very rapidly. This rapid rise in pressure, compared with a fully sealed system, achieves higher pressures than would otherwise be possible. The projectile experiences a much larger acceleration due to the much larger pressure generated. This system can be tuned for different barrel lengths to achieve optimum muzzle velocity with a given amount of piston travel and available spring force. Further venting of the tip of the barrel can be sued to dissipate any residual pressure so that the projectile does not experience any air blasé of residual air as it exits the barrel. Such air blast could upset the trajectory and lead to increased error in the projectile's point of impact.

In one embodiment, guides and bearing surfaces near the end of the piston can be notched to allow for more air leakage when desired. Any feature which divides the barrel and piston interface into two sections during the piston travel can be implemented wherein a first second allows air leakage and a second section prevents air leakage.

Figure 13:
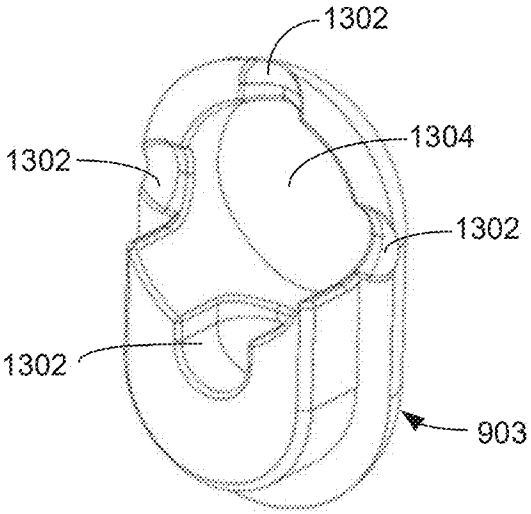
FIG. 13 illustrates a bumper structure according to an embodiment.

FIG. 13, shows an enlarged view of the bumper 903 according to an embodiment. As can be seen, the bumper 903. As can be seen, the bumper includes one or more recessed channels 1302 for allowing air flow as described above with reference to FIGS. 10-12. In addition, the bumper 902 includes an opening 1304 for allowing passage of the loading tip 1020 (FIGS. 10-12) therethrough. As mentioned above, any way of smoothly moving the air from its axial flow into discrete channels that smoothly turn the flow will help to improve the efficiency of the blaster and lead to increased muzzle energy for a given spring load air system design.

EXAMPLE CLAUSES

The example clauses below represent example embodiments of the present disclosure.

Clause A: An assembly includes, a frame including a grip; a first sidewall; a second sidewall opposite the first sidewall; a front block fixed to the first and second sidewalls, and movable with the first and second sidewalls relative to the grip; a substantially cylindrical barrel fixed relative to the frame and defining a central longitudinal axis; a substantially concentrical piston concentric with and movable along an outer surface of the barrel; and a nut, supported by the front block, the nut configured to: releasably mate with the piston when the first block is moved in a first direction, parallel to the longitudinal axis, toward the grip, and cause movement of the piston together with the front block in a second direction, parallel to the longitudinal axis and opposite the first direction, when the front block is moved in the second direction and while the nut is releasably matched with the piston, wherein: disengaging the nut from the piston permits movement of the piston, in the first direction and away from the front block, under a force applied by a resistance component.

Clause B: The assembly as in clause A, the frame further including a third sidewall and a fourth sidewall opposite the third sidewall, the third and fourth sidewalls being fixed relative to the grip, the first sidewall being slidably engaged with the third sidewall, and the second sidewall being slidably engaged with the fourth sidewall.

Clause C: The assembly as in clause A or B, further comprising: a front plate fixed to the front block and configured to retain the nut within the front block; and a port block fixed to the third and fourth sidewalls, the front plate being movable with the front block relative to the port block, and the barrel being fixed relative to the port block.

Clause D, The assembly as in clause A, B, or C further comprising a plunger fixed to the piston and positioned opposite the front plate, the resistance component applying the force to the plunger and the front plate to cause movement of the piston in the first direction and away from the front block.

Clause E: The assembly as in clause A, B, C or D, wherein an outer surface of the piston defines a helical groove, the nut mating includes a detent configured to mate with the helical groove when the nut is releasably mated with the piston.

Clause F: The assembly as in clause A, B, C, D, or E, wherein the resistance component comprises a spring disposed substantially concentric with the piston.

Clause G: The assembly as in clause A, B, C, D, E, or F, wherein movement of the front block in the first direction causes compression of the resistance component between the plunger and the front plate.

Clause H: The assembly as in clause A, B, C, D, E, F, or G, wherein the plunger forms a substantially fluid tight seal with an air chamber of the assembly, and movement of the plunger, together with the piston in the second direction, draws air into the air chamber.

Clause I: The assembly as in clause A, B, C, D, E, F, G, or H, further comprising a cap disposed opposite the plunger and forming a part of the air chamber, the cap being configured to direct air exiting the air chamber to pass into the barrel.

Clause J: The assembly as in clause A, B, C, D, E, F, G, H, or I, wherein movement of the piston in the first direction, under the force applied by the resistance component, causes air to enter a passage formed by the cap in the first direction, the passage causing the air exiting the air chamber to pass into the barrel in the second direction.

Clause K: The assembly as in clause A, B, C, D, E, F, G, H, I, or J, wherein movement of the piston in the first direction, under the force applied by the resistance component, causes the air passing into the barrel to expel a projectile from the barrel in the second direction.

Clause L: The assembly as in clause A, B, C, D, E, F, G, H, I, J or K, further comprising a latch pivotally connected to the front block, and a trigger configured to engage the latch, wherein engagement of the latch by the trigger causes the nut to disengage from the piston.

Clause M: The assembly as in clause A, B, C, D, E, F, G, H, I, J, K or L, wherein an outer surface of the piston defines a helical groove, and a detent of the nut mates with the groove when the nut is releasably mated with the piston.

Clause N: An air launch apparatus, comprising: a first sidewall; a second sidewall opposite the first sidewall; a front block fixed to the first sidewall and the second sidewall; a frame, comprising a third sidewall, a fourth sidewall opposite the third sidewall, and a grip, wherein: the first sidewall is disposed adjacent to the third sidewall, the second sidewall is disposed adjacent to the fourth sidewall, and the front block is moveable, together with the first sidewall and the second sidewall, relative to the frame; a substantially cylindrical barrel fixed relative to the frame and defining a central longitudinal axis; a substantially cylindrical piston concentric with and moveable along an outer surface of the barrel; a plunger fixed to the piston and disposed opposite the front block; a spring extending from the front block to the plunger; a nut supported by the front block, the nut configured to: releasably mate with the piston when the front block is moved, in a first direction parallel to the longitudinal axis and toward the grip, to a first position; and when the front block is moved in a second direction opposite the first direction and while the nut is releasably mated with the piston, cause movement of the piston, together with the front block, the first sidewall, and the second sidewall, in the second direction, to a second position, wherein: disengaging the nut from the piston permits movement of the piston, in the first direction and away from the from the front block, under a force applied to the piston by the spring.

Clause O: An air launch apparatus as in clause N, wherein the spring is disposed concentric with the piston, and movement of the front block to the first position compresses the spring between the front block and the piston.

Clause P: An air launch apparatus as in clause N, or O, further comprising an air chamber disposed between the first sidewall and the second sidewall, wherein: the plunger forms a substantially fluid-tight seal with the air chamber, movement of the plunger, together with the piston, in the second direction, draws air into the air chamber, and movement of the plunger, together with the piston, in the first direction, under the force applied by the spring, cause the air to exit the air chamber.

Clause Q: An air launch apparatus as in clause N, O, or P, further comprising a cap disposed opposite the plunger and forming at least part of the air chamber, the cap being configured to direct the air exiting the air chamber to pass into the barrel in the second direction.

Clause R: A method of manufacturing an air launch apparatus, the method comprising: providing a first sidewall; providing a second sidewall; fixing a front block to the first sidewall and the second sidewall such that the first sidewall is disposed opposite the second sidewall; providing a frame, comprising a third sidewall, a fourth sidewall opposite the third sidewall, and a grip; slidably coupling the first sidewall to the frame such that the first sidewall is moveable substantially along the third sidewall; slidably coupling the second sidewall to the frame such that the second sidewall is moveable substantially along the fourth sidewall; fixing a port block to the third sidewall and the fourth sidewall, the port block being disposed opposite the front block; fixing a substantially cylindrical barrel to the port block, the barrel defining a central longitudinal axis; positioning a substantially cylindrical piston concentric with and moveable along an outer surface of the barrel; fixing a plunger to the piston, the plunger being disposed opposite the front block; providing a spring extending from the front block to the plunger; and providing a nut supported by the front block, the nut configured to: releasably mate with the piston when the front block is moved, in a first direction parallel to the longitudinal axis and toward the grip, to a first position; when the front block is moved in a second direction opposite the first direction and while the nut is releasably mated with the piston, cause movement of the piston, together with the front block, the first sidewall, and the second sidewall, in the second direction, to a second position, wherein: disengaging the nut from the piston permits movement of the piston, in the first direction and away from the from the front block, under a force applied to the piston by the spring.

Clause S: A method of manufacturing an air launch apparatus as in clause R, further comprising: providing an air chamber disposed between the first sidewall and the second sidewall; and forming a substantially fluid-tight seal between the plunger and the air chamber, wherein: movement of the plunger, together with the piston, in the second direction, draws air into the air chamber, and movement of the plunger, together with the piston, in the first direction, under the force applied by the spring, cause the air to exit the air chamber.

Clause T: A method of manufacturing an air launch apparatus as in clause R or S, further comprising providing a cap forming at least part of the air chamber, the cap being disposed opposite the plunger, and being configured to direct the air exiting the air chamber to pass into the barrel in the second direction.

Clause U: An air launch apparatus, comprising: a cylindrical barrel defining a longitudinal axis; piston having an opening that is concentric with the cylindrical barrel, the piston being configured to slidably engage an outer surface of the barrel along the longitudinal axis; and an air chamber at least a portion of which surrounds at least a portion of the cylindrical barrel; wherein movement of the piston in a first direction along the longitudinal axis compresses air within the chamber and causes air to flow into the barrel in a second direction that is opposite the first direction.

Clause V: An air launch apparatus as in clause U, wherein at least a portion of the air chamber and a portion of the barrel are located in a common location as measured along the longitudinal axis.

Other embodiments of the present disclosure will be apparent to those skilled in the art from consideration of the specification and practice of the embodiments described herein. It is intended that the specification and examples be considered as example only, with a true scope and spirit of the present disclosure being indicated by the following claims.

What is claimed is:

1. An assembly, comprising:
- a frame including a grip;
- a first sidewall;
- a second sidewall opposite the first sidewall;
- a front block fixed to the first and second sidewalls;
- a substantially cylindrical barrel fixed relative to the frame and defining a central longitudinal axis;
- a piston concentric with and movable along an outer surface of the barrel; and
- a nut, supported by the front block, the nut configured to:
  - releasably mate with the piston, and
  - cause movement of the piston together with the front block, in a direction parallel to the longitudinal axis, while the nut is releasably mated with the piston.

2. The assembly of claim 1, further comprising a plunger disposed at a rear end of the piston, and a biasing spring disposed circumferentially around the piston.

3. The assembly of claim 2, wherein movement of the front block in a direction toward the plunger causes compression of the biasing spring.

4. The assembly of claim 1, further comprising:
- one or more detents disposed on a surface of the nut, the one or more detents configured to engage corresponding one or more grooves formed by the piston.

5. The assembly of claim 4, wherein the one or more grooves are helical such that engagement of the one or more detents with the one or more grooves causes the nut to rotate as the nut engages the piston.

6. The assembly of claim 1, further comprising:
- a notch formed by the nut; and
- a latch configured to engage the notch to hold the nut in engagement with the piston.

7. The assembly of claim 6, further comprising a trigger in communication with the latch, wherein movement of the trigger disengages the latch from the notch.

8. The assembly of claim 1, further comprising a loading block connected to the first and second sidewalls, wherein the grip is connected to the loading block.

9. The assembly of claim 2, wherein:
- the plunger forms a substantially fluid-tight seal with an air chamber formed within the frame, and
- movement of the plunger in a first direction compresses air within the air chamber.

10. The assembly of claim 9, wherein an O-ring disposed around an outer periphery of the plunger forms the substantially fluid-tight seal.

11. The assembly of claim 9, further comprising a bumper disposed within the air chamber, wherein impact between the plunger and the bumper restricts movement of the plunger within the air chamber.

* * * * *